United States Patent [19]

Uyeda

[11] 4,062,210

[45] Dec. 13, 1977

[54] TIME LOCKS

[75] Inventor: Tim M. Uyeda, South San Gabriel, Calif.

[73] Assignee: Sargent & Greenleaf, Inc., Nicholasville, Ky.

[21] Appl. No.: 653,892

[22] Filed: Jan. 30, 1976

[51] Int. Cl.[2] ..... E05B 43/00

[52] U.S. Cl. ..... 70/268; 70/272

[58] Field of Search ..... 70/267, 268, 269, 270, 70/271, 272, 273, 274, 214, 288, 465; 350/112

[56] References Cited

U.S. PATENT DOCUMENTS

| | | | |
|---|---|---|---|
| 219,084 | 9/1879 | Fowler | 70/272 |
| 526,555 | 9/1894 | Blake | 70/273 |
| 573,855 | 12/1896 | Blake | 70/273 |
| 588,627 | 8/1897 | Blake | 70/273 |
| 1,722,071 | 7/1929 | Benham | 70/273 |
| 2,140,698 | 12/1938 | Goehring | 70/268 |
| 2,202,534 | 5/1940 | McGunn | 70/274 |
| 2,285,328 | 6/1942 | Clarkson et al. | 70/272 X |
| 2,539,654 | 1/1951 | Barnes | 350/112 X |
| 2,960,046 | 11/1960 | Clark | 70/267 X |
| 3,041,917 | 7/1962 | Glatt | 350/112 |
| 3,119,248 | 1/1964 | Kaminsky | 70/272 |
| 3,340,710 | 9/1967 | O'Brien | 70/271 |
| 3,950,678 | 4/1976 | Brewer | 70/271 X |

*Primary Examiner*—Roy D. Frazier
*Assistant Examiner*—Thomas J. Holko
*Attorney, Agent, or Firm*—Mason, Fenwick & Lawrence

[57] ABSTRACT

Improvements in time locks for use in safes, vaults, or the like wherein the lock includes a clockwork mechanism which can be preset to a time until which the safe or vault cannot be opened. The improvements include improved means for bypassing the clockwork mechanism should one be locked inside the safe or vault on which the lock is installed. An improved simplified housing is provided for the time lock so that the entire lock need not be disassembled if there is a malfunction of the clockwork mechanism. Improved viewing means for the time lock are provided so that the face of the clockwork mechanism can be viewed from a convenient location above and at an angle to the face of the clockwork mechanism. An anti-tampering mechanism prevents the locking bolt from being released even if the device in which the lock is installed is dropped or vibrated. Finally, various other improvements are presented in other parts of the lock, such as the release lever assembly for releasing the locking bolt.

16 Claims, 14 Drawing Figures

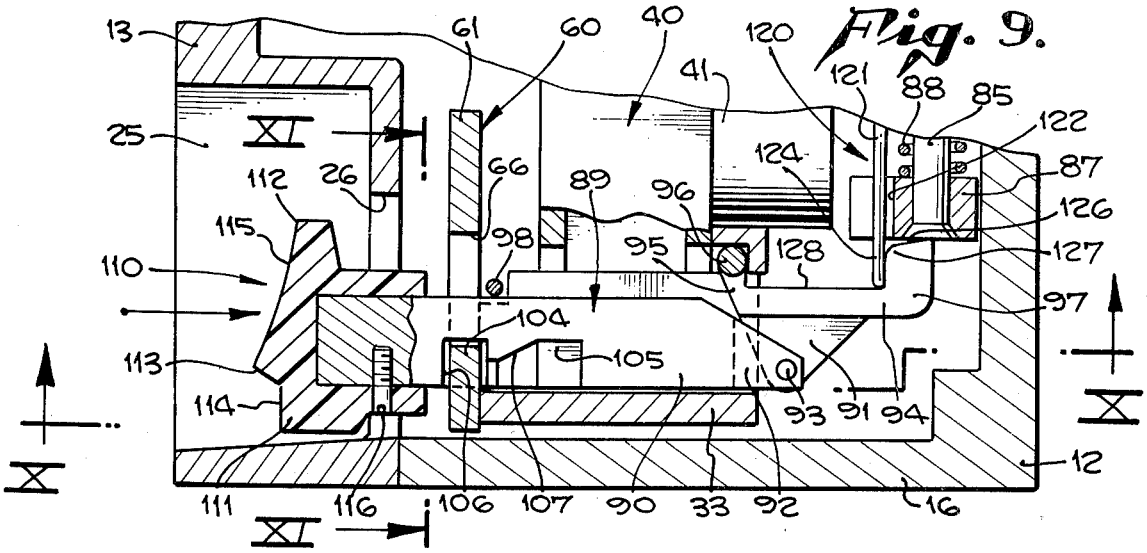
Fig. 9.
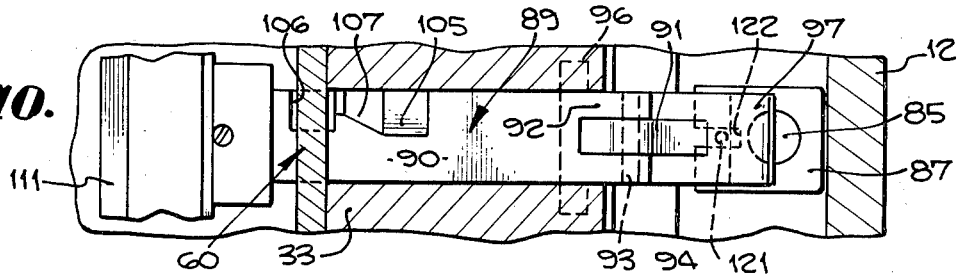
Fig. 10.
Fig. 11.
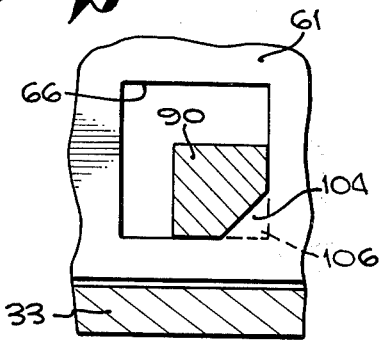
Fig. 12.
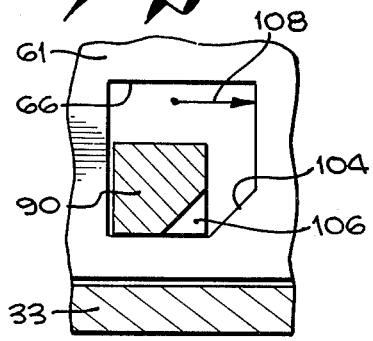
Fig. 14.
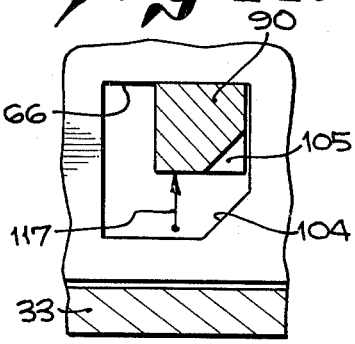
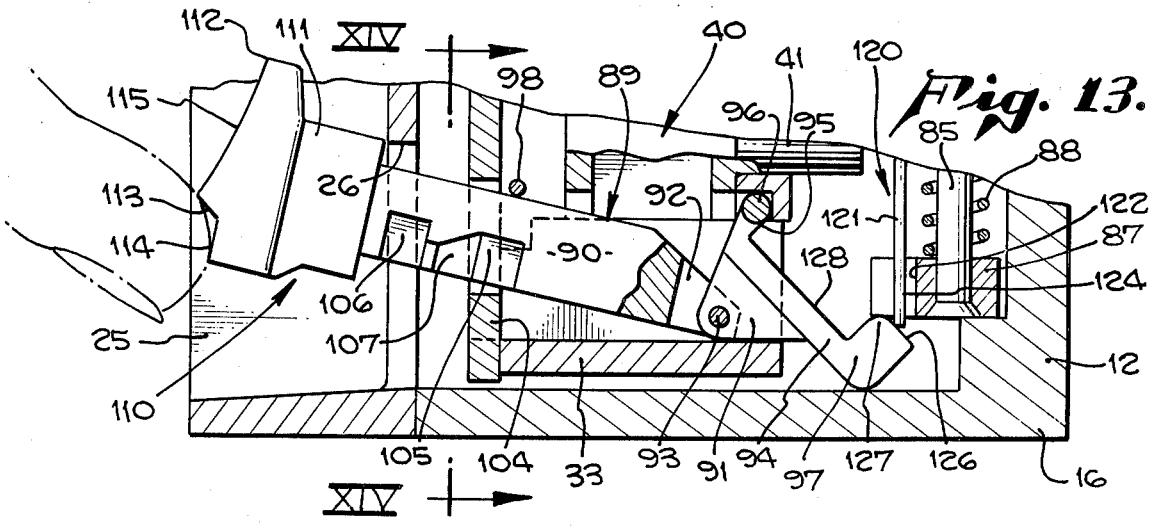
Fig. 13.

TIME LOCKS

BACKGROUND OF THE INVENTION

1. Field of the Invention

The invention relates to time locks, and, more particularly, to improvements in time locks which are used to prevent a vault door or the like from being opened except at a predetermined time.

2. Description of the Prior Art

Time locks have been known for many years for preventing safes, vaults, or the like from being opened except at a predetermined time. Generally, such clocks have a precision clockwork movement which permits a setting of a desired time at which the time lock may be opened. The clockwork in certain such locks then allows a bolt or the like engaging the lock to retract so the vault or door may be opened.

Some such time locks have safety devices in the form of emergency releases to allow the lock to be opened should one be locked inside the vault or safe. Such devices may comprise means connected to a knob or bar accessible from the front of the time lock case. By pushing such knob or bar in a predetermined direction, the clockwork mechanism is bypassed and the locking bolt is released.

Generally, such time locks are installed at a very low location on the safe or vault door. Known prior art time locks have a plain glass viewing surface for viewing the clocks of such locks. Thus, one desiring to view such clocks must bend down close to the floor and view the clock face or faces in a direction directly perpendicular to the face or faces. This is uncomfortable and awkward. There is thus a need for a time lock which can be viewed at an angle from above the face of the clock or clocks.

The release knob or bar on such time locks should be configured for easy and positive release by all types of users. If such locks are installed on a safe or the like, such safes could be dropped and inertia would release the locking bolt. There is thus a need for a time lock wherein the locking bolt cannot be released even if the safe is dropped or vibrated or the like. Such a mechanism would therefore act as an anti-theft or anti-tampering mechanism.

Known time locks must be completely taken apart if the clockwork mechanism doesn't work and the locking bolt is not released. There is thus need for a time lock housing which does not require complete disassembly due to malfunction of the clockwork mechanism.

As discussed, known time locks have clockwork mechanisms which can be preset to a desired time to open the vault or safe associated with the lock. There is a need for quickly and easily calibrating such a clockwork mechanism to the actual time so that the time lock is accurate with respect to the actual time.

OBJECTS AND SUMMARY OF THE INVENTION

It is an object of this invention to provide improvements in time locks which are used to prevent safes or vaults or the like from opening except at a predetermined time.

It is a further object of this invention to provide improved safety devices in such time locks for bypassing the clockwork mechanism should one be locked inside the vault or safe in which the lock is installed.

It is still another object of this invention to provide improved viewing means for such time locks for viewing the clockwork mechanism thereof wherein such mechanism may be viewed from a point above the face of the clockwork mechanism and at an angle thereto.

It is a further object of this invention to provide a simplified improved housing for such a time lock which does not require disassembly of the entire time lock if there is a malfunction in the clockwork mechanism and the locking bolt remains in a locked position.

It is a further object of this invention to provide a simplified improved housing for such a time lock which does not require disassembly of the entire time lock if there is a malfunction in the clockwork mechanism and the locking bolt remains in a locked position.

It is still another object of this invention to provide anti-theft or anti-tampering means for such time locks so that the locking bolt cannot be released due to inertia if the device in which the time lock is installed is vibrated or dropped.

These and other objects are preferably accomplished by providing an improved time lock having means for bypassing the clockwork mechanism should one be locked inside the safe or vault on which the lock is installed. An improved simplified housing is provided for the time lock so that the entire lock need not be disassembled if there is a malfunction of the clockwork mechanism. Improved viewing means for the time lock are provided so that the face of the clockwork mechanism can be viewed from a convenient location above and at an angle to the face of the clockwork mechanism. An anti-tampering mechanism prevents the locking bolt from being released even if the device in which the lock is installed is dropped or vibrated. Finally, other improvements are presented in other parts of the lock, such as the release lever assembly for releasing the locking bolt.

BRIEF DESCRIPTION OF THE DRAWINGS

FIG. 9 is a view similar to a portion of FIG. 3, showing another position of the mechanism thereof;

FIG. 10 is a view taken along lines X—X of FIG. 9;

FIG. 11 is a view taken along lines XI—XI of FIG. 9;

FIG. 12 is a view similar to the view in FIG. 11 showing an alternate position of the components therein;

FIG. 13 is a view similar to the view of FIG. 9 showing an alternate position of the components therein; and FIG. 14 is a view taken along lines XIV—XIV of FIG. 13.

DESCRIPTION OF THE PREFERRED EMBODIMENT

Figure 1:
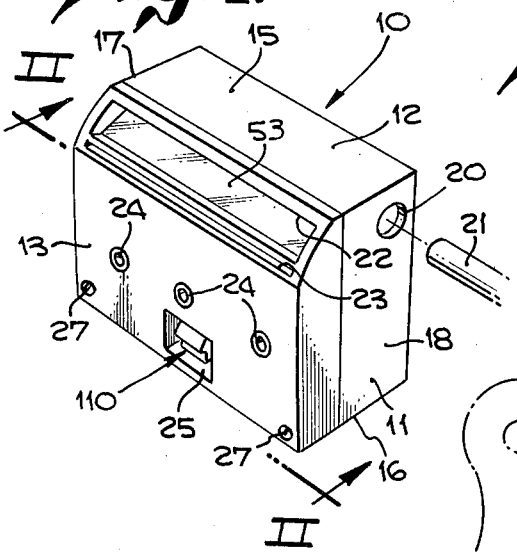
FIG. 1 is a perspective view of an improved time lock in accordance with the invention.

Referring to FIG. 1 of the drawing, a time lock 10 in accordance with the teachings of the invention is shown. As particularly contemplated in the present invention, time lock 10 includes housing means 11 for housing therein the various components making up time lock 10. Such components include a conventional clockwork mechanism 40 for setting the time lock 10 to open at a pre-set time; calibrating means 70 for calibrating the clockwork time to correspond to the actual time; improved viewing means 50 for viewing the face of the clockwork mechanism; snubber bar blocking means 80 controlled by the clockwork mechanism 40 to block a snubber bar or the like in the door or wall of the safe or vault in which time lock 10 is installed; anti-tampering means 120 for preventing the snubber bar blocking means 80 from releasing the snubber bar by vibrating or dropping the apparatus on which the time lock 10 is installed; manual release means 110 for releasing the snubber bar blocking means 80 independent of the clockwork mechanism 40; and time setting means 60 for presetting the clockwork mechanism so that the time lock 10 opens only at a preset time.

Figure 3:
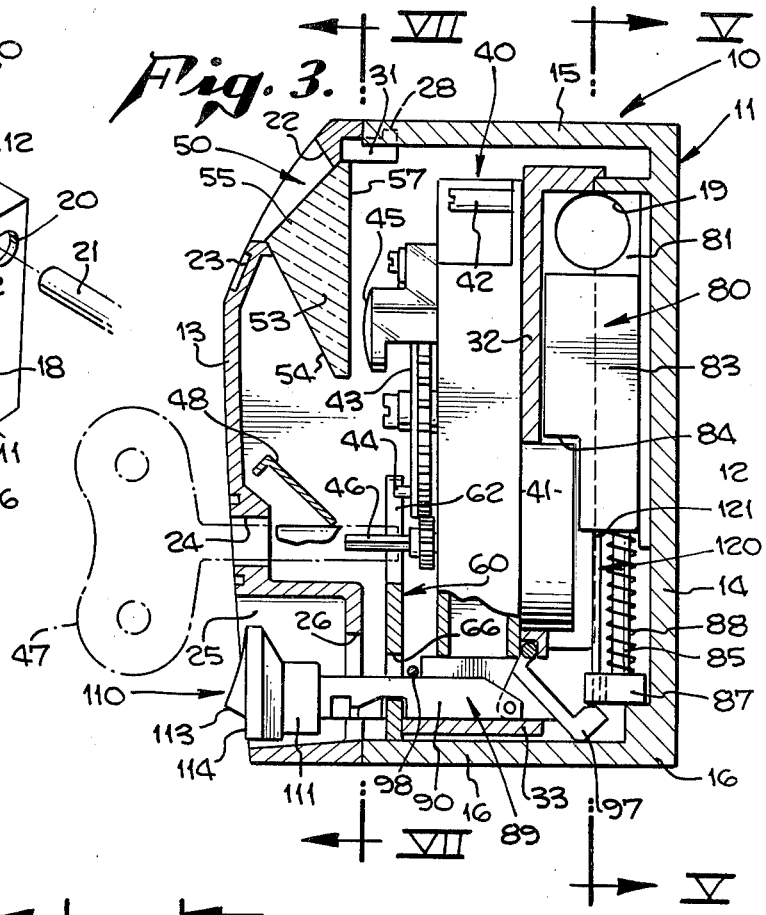
FIG. 3 is a view of the time lock taken along lines III—III of FIG. 2.
Figure 2:
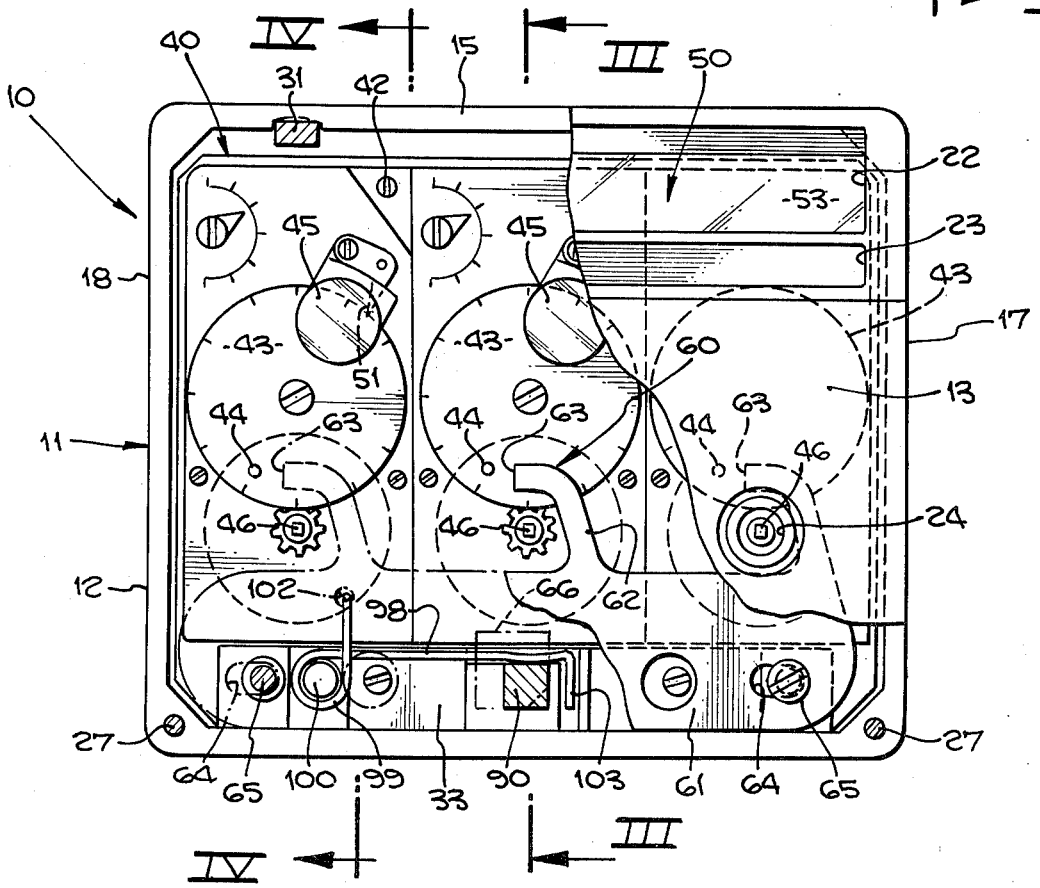
FIG. 2 is a view of the time lock taken along lines II—II of FIG. 1.
Figure 5:
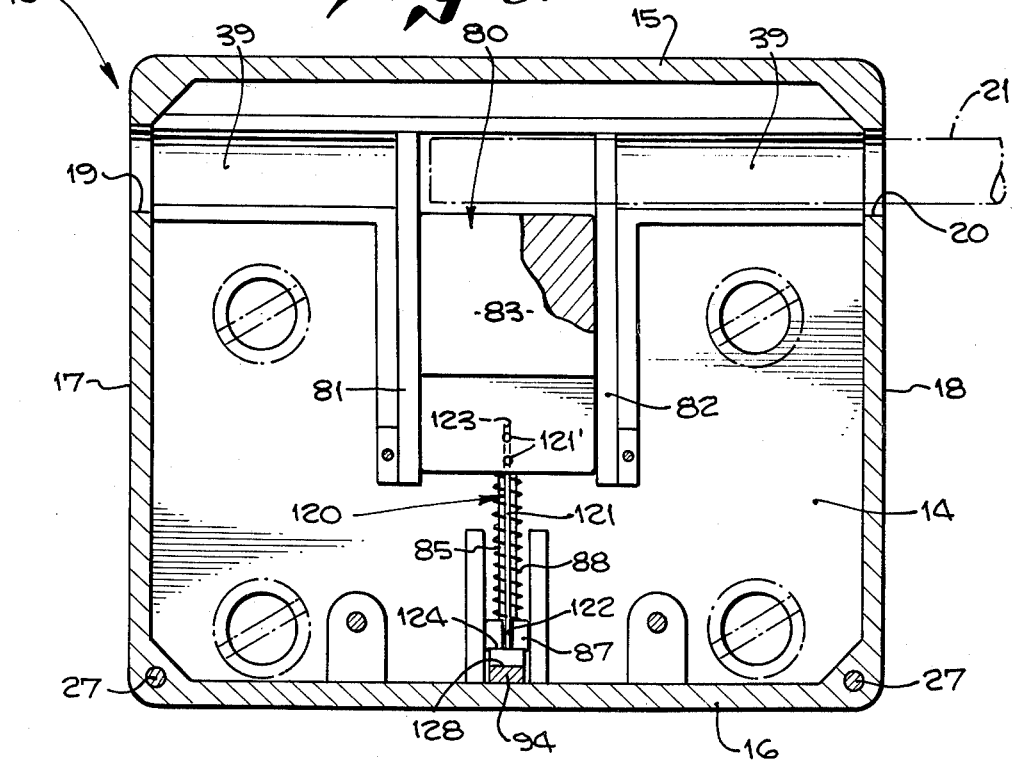
FIG. 5 is a view of the time lock taken along lines V—V of FIG. 3.
Figure 8:
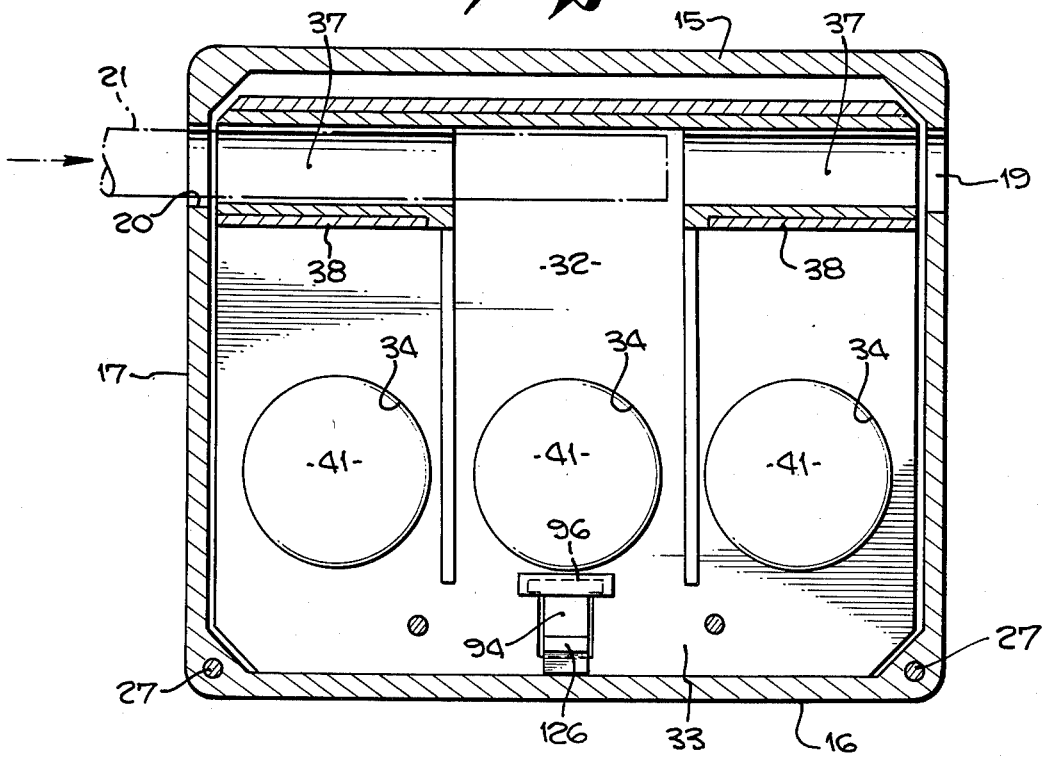
FIG. 8 is a view of the time lock taken along lines VIII—VIII of FIG. 4.

Thus, referring once again to FIG. 1 and more particularly to FIGS. 2 and 3, as particularly contemplated in the present invention, housing means 11 includes, in the exemplary embodiment, a two-piece housing, i.e., a main housing portion 12 and a front cover 13. Main housing portion 12 is comprised of a one-piece structure having a rear wall 14, top and bottom walls 15 and 16, respectively, and side walls 17,18. As shown in FIG. 5 linearly aligned apertures 19 and 20 are formed in each side walls 17 and 18 respectively, adjacent top wall 15. As will be discussed, housing means 11 includes a normally unblocked path between apertures 19 and 20 for receiving a locking bolt or a snubber bar 21 therein as shown particularly in FIGS. 1, 5 and 8. Such a locking bolt or bar is normally provided in the wall of the vault or safe in which time lock 10 is installed.

Figure 4:
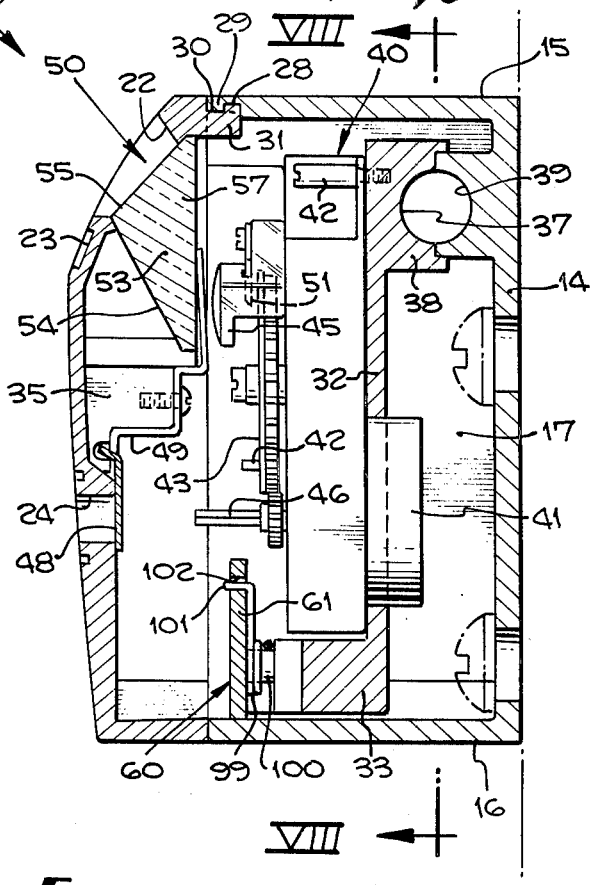
FIG. 4 is a view of the time lock taken along lines IV—IV of FIG. 2.

Cover 13 includes an elongated cut-out window portion 22 and a narrower elongated cut-out portion 23. A plurality of linearly aligned key receiving apertures or holes 24 are also provided in cover 13 below cut-out portion 23. A recessed cavity 25 is provided below holes 24 and includes an aperture 26 therein for access to the manual release means 110, as will be discussed. Suitable screws 27 or the like may be used to secure cover 13 to main housing portion 12. As can be seen in FIGS. 3 and 4, main housing portion 12 includes a groove 28 and a reduced portion 29 in top wall 15 configured to receive a like groove and reduced portion 30,31, respectively, along the top of cover 13. In this manner, groove 30 and portion 31 of cover 13 may be hooked in groove 28 and portion 29 of housing portion 12 and screws 27 to secure cover 13 in place in a quick, easy manner.

As particularly contemplated in the present invention, a conventional clockwork mechanism 40 may be secured to a partition 32 having a base portion 33 resting on bottom wall 14 as is seen in FIG. 4. Partition 32 has one or more generally circular openings 34 (see particularly FIG. 8) for receiving the spring housing 41 of the clockwork mechanism 40 (see FIG. 4). Such a clockwork mechanism 40 is conventional and forms no particular part of this invention other than in the environment claimed. As is also conventional in time locks of this type, the clockwork mechanism 40 has more than one clock, such as three, only one being necessary with the others being used as back-up mechanisms. Mechanism 40 is secured to partition 32 by suitable screws 42. The face 43 of each clock carries a pin 44 for reasons to be discussed. Magnifiers 45 may be associated with each clock for easily reading the time of each clock. Each clock has a winding shaft 46 for receiving a winding key 47 through each aperture 24 to wind each clock. A displaceable dust cover 48 (see particularly FIG. 7) normally closes apertures 24, lifting to open when key 47 is inserted. This cover 48 is retained in position by a pair of hold-down clips 49 secured to portion 35 of housing portion 12 by suitable screws 36.

The remaining portions of clockwork mechanism 40 are conventional as discussed and further description is deemed unnecessary. Any suitable time movement may be used which is capable of keeping accurate time for the length of time desired. It is to be understood that by winding shafts 46, the gearing means of each clock actuates the spring (not shown) to thereby wind each clock.

Figure 7:
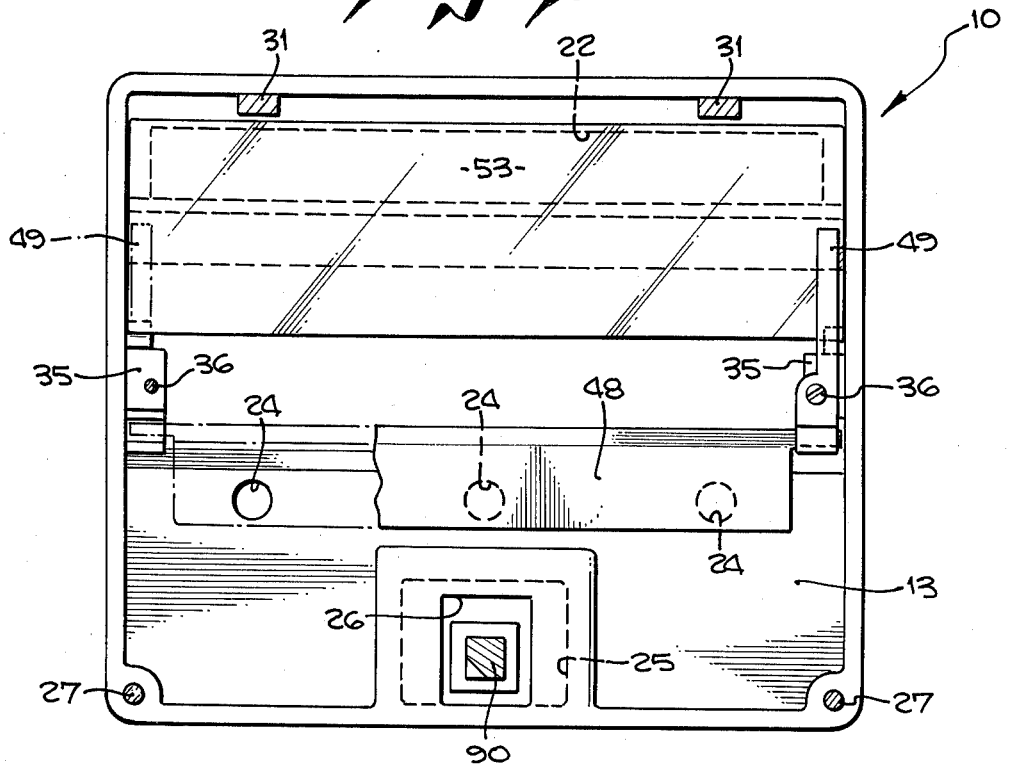
FIG. 7 is a view of the time lock taken along lines VII—VII of FIG. 3.

Referring once again to FIG. 2 and more particularly to FIGS. 4 and 7, as particularly contemplated in the present invention, time lock 10 includes viewing means 50 for quickly and easily viewing the magnified area of the clock faces 43 indicated at pointer 51. Thus, in the exemplary embodiment, viewing means 50 includes a prism means in the form of a prism 53 secured within cover 13 by holddown clips 49 as shown in FIGS. 4 and 7. Prism 53 is preferably blackened at each end and includes a reflective coating 54 on its bottom surface. Thus, an inclined surface 55 is visible through cut-out portion 22. Any suitable dimensions for prism 53 may be used so that, when viewing in the direction of arrow 56, the indicia on face 43 under magnifier 45 is visible. For example, surface 54 may be at any angle of about 30° to back surface 57 and viewing surface 55 may be at an angle of about 45° to back surface 57.

As particularly contemplated by the present invention, time setting means 60 are provided for presetting the clock to a desired time when the lock may be opened. In the exemplary embodiment, such time setting means 60 includes a carrier assembly 61 having an upstanding hooked arm 62 for each clock face 43. As can be seen in FIG. 2, each arm 62 terminates in an abutment surface 63 adapted to be engaged by each pin 44. As is well known in the time lock art, when pin 44 abuts against surface 63, it moves assembly 61 to the right in FIG. 2 (the clock faces 43 moving in a counterclockwise direction). Thus, the coaction of surface 63 and pin 44 of clockwork mechanism 40 acts as a timed release means for lock 10 as will be discussed. Assembly 61 includes one or more openings 64 for receiving screws 65 therethrough to secure assembly 61 to suitable apertures in the base portion 33 of partition 32.

As particularly contemplated in the present invention, time lock 10 includes snubber bar blocking means 80 for selectively blocking a snubber bar 21 receivable in apertures 19,20. As can be seen in FIG. 4, housing means 11 includes a semi-circular opening 37 formed in an upper portion 38 of partition 32. A like mating semi-circular opening 39 is formed in back wall 14. The two portions or openings 37,39 are aligned with apertures 19,20 and thus form a path for receiving snubber bar 21 through housing means 11. As particularly shown in FIG. 5, partition 32 includes spaced walls 81,82 forming a path for receiving the blocking means 80 therein.

Figure 6:
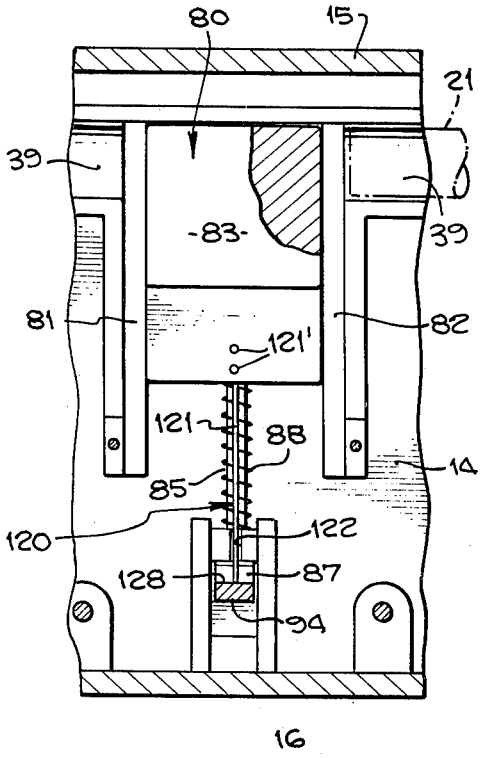
FIG. 6 is a view, similar to a portion of the view of FIG. 5, showing an alternate position of a portion of the mechanism thereof.

Thus, blocking means 80 includes a block or slide 83 movable between walls 81,82 from a first position out of the path of snubber bar 21 (FIG. 5) to a second position into the path of snubber bar 21 (FIG. 6). As can be seen in FIG. 3, the upper surface of the spring housing 41 acts as a stop for block 83. That is, block 83 includes a cut-out portion 84 which engages housing 41 as it moves downwardly. A slide pin 85 is slidably received in an opening in the underside 86 of block 83 and terminates in a head portion 87. A spring 88 encircles pin 85 between head portion 87 and underside 86.

Blocking means 80 further includes a lever assembly 89 which includes a lever actuator or control member 90 movable through the slot or opening 66 in carrier assembly 61. As particularly seen in FIGS. 9 and 13, assembly 89 includes a generally triangularly shaped pivotal lever portion 91 having its apex pivotally connected to a bifurcated portion 92 formed in the distal end of lever actuator 90 (see FIG. 10) by a pivot pin 93. The base of portion 91 is integrally secured to a generally U-shaped abutting member 94 having one leg 95 pivotally connected to the base portion 33 of partition 32 by pivot pin 96 and the other leg 97 underlying the head portion 87 of pin 85.

Blocking means 80 further includes a spring 98 (see particularly FIGS. 2 and 4) having a coiled portion 99 secured about a bolt 100 or the like on housing means 11 and one free end 101 disposed in an aperture 102 in carrier assembly 61 (FIG. 4 and the other free end 103 overlying lever actuator 90 (see FIG. 2). Spring 98 thus normally biases carrier assembly 61 to the left in FIG. 2 and thus surfaces 63 are biased into engagement with pins 44. Simultaneously, lever actuator 90 is retained as normally biased in the down or FIG. 11 position.

As shown in FIG. 9, lever actuator 90 extends through slot 66 in carrier assembly 61. Slot 66, as particularly shown in FIGS. 11, 12 and 14, is generally square-shaped with the right corner of the bottom of square-shaped opening being closed off by abutment means, such as a generally right triangular-shaped portion 104. As can be seen by comparing FIG. 9 with FIG. 10, lever 90 includes abutment engaging means thereon for engaging portion 104, such as being cut out along one side thereof to form a first notch 105 and a spaced second notch 106. A tapered notch 107 interconnects first and second notches 105 and 106.

As can be seen in FIG. 11, lever actuator 90 extends through opening or slot 66 with carrier assembly 61 and lever actuator 90 biased by spring 98 into a position whereby notch 106 on lever actuator 90 abuts against portion 104 of slot 66. When carrier assembly 61 is moved to the right in FIG. 2 by pins 44, as discussed, and in the direction of arrow 108 in FIG. 12, the notch 106 in lever actuator 90 no longer abuts against portion 104. The downward force of spring 88 forces head portion 87 of slide pin 85 against leg 97 of member 94 which moves lever actuator 90 to the left in FIG. 9 (and thus through slot 66 as lever actuator 90 is in the FIG. 12 position) to lower block 83.

As particularly contemplated in the present invention, manual release means 110 are provided for overriding the timed release of time lock 10 should one for example, be locked in the vault accidently. Thus, in the exemplary embodiment, manual release means 110 includes the aforementioned notches 105 and 107 on lever actuator 90 and a push-button 111 connected to the forward end of lever actuator 90 (see FIG. 3). This push button 111 extends into cavity 25 of housing means 11 and is accessible therein. Push-button 111 includes a first outwardly and downwardly extending tapered portion 112, then a second inwardly and downwardly sloped portion 113 and finally a generally straight downwardly extending portion 114. Portion 112 may be slightly inwardly arcuate, as at surface 115 as seen particularly in FIG. 9, for ease of operation. Push-button 111 may be removably secured to lever actuator 90 by a suitable screw 116 as also shown in FIG. 9.

Referring to FIG. 13, in operation, push-button 111 may be lifted with a finger at portions 113,114, as shown, it being understood that lever actuator 90 is in the FIG. 9 or blocking position. This lifts lever actuator 90 against the downward bias of spring 98 in the direction of arrow 117 in FIG. 14. Lever 90 thus moves to the left in FIG. 9 and may be pushed down at surface 115 so that notch 105 engages portion 104, as shown in FIG. 13, to thereby release block 83 and retain lever actuator 90 in the unblocked position.

Also, as particularly contemplated in the present invention, anti-tampering means 120 are provided so that block 83 cannot be released from blocking position even if time lock 10 is dropped, vibrated or the like. That is, block 83 is immobilized in the locked position regardless of inertia or vibration acting thereon. In the exemplary embodiment, anti-tampering means 120 includes a elongated wire 121 (see FIGS. 5 and 6) having its lower end 124 extending through an aperture 122 in head portion 87 of slide pin 85 (see particularly FIGS. 9 and 13) to a point of engagemment with member 94. The other end of wire 121 extends through and is fixed in an aperture 123 in block 83 (see FIG. 5) and center punched therein as indicated by punch holes 121' which bend wire 121 in place.

In operation, as can be seen by comparing FIGS. 9 and 13, wire 121 is disposed (FIG. 9) adjacent leg 97 of member 94 when block 83 is in the snubber bar blocking or up position. If someone took the time lock 10 (or the device in which it is installed) and lifted it and dropped or vibrated it, the block 83 would normally move downwardly due to inertia acting on block 83. However, when lever actuator 90 is moved from the FIG. 13 to the FIG. 9 position, the lower end 125 of wire 121 moves along the camming surface 126 of leg 97, this surface 126 being inclined from a high point away from lever actuator 90 to a low point adjacent lever actuator 90, and assumes its normal point of engagement with leg 97 whereupon the stiff wire 121 holds the block 83 in the up or blocking position and thus immobilizes block 83 when in locking position and prevents tampering of time lock 10. The block 83 cannot be lowered by inertia or the like; lever actuator 90 must be actuated to lower block 83.

Although the operation of various portions of time lock 10 have been heretofore described, a brief summary is as follows. After installing time lock 10 on a vault or safe or the like in a position whereby aperture 20 is aligned with a snubber bar 21 installed on the vault or safe door, key 47 is inserted through each hole 24 to selectively engage shafts 46 and thus wind each clock of the clockwork mechanism 40. The key 47 is of course removed after winding.

The lapsed hours of each clock are visible from a point above and at an angle thereto through prism 53 (i.e., approximately 45° thereto).

Should it be necessary to remove and replace the clockwork mechanism 40 for any reason, the housing means 11 can be quickly and easily dismantled by removing cover 13 and unscrewing the mechanism 40 from main housing portion 12. Thus, even if the snubber bar 21 is locked in position, the two-piece mating sections 38 and 39 permit section 38 and its accompanying components to be removed without the necessity of dismantling the entire lock 10. Snubber bar 21, as shown in FIG. 4, has its vertical section through the point of mating of sections 38,39.

While the time lock 10 is open, snubber bar 21 is inserted into aperture 20 between openings 37,39 and above block 83. Lever actuator 90 is pushed at sloped surface or portion 113 to move lever actuator 90 to the position shown in FIG. 9. Wire 121 is urged rearwardly by the leg 97 of member 94 while the latter rises to the FIG. 9 position lifting the head portion 87 of the slide pin 85 and block 83 abuts against the bottom of snubber bar 21 as shown in FIG. 5 (spring 88 being compressed). Notch 106 of lever actuator 90 is in the FIGS. 9 and 11 position thus retaining the lever actuator 90 in place when clockwork mechanism 40 is set and carrier assembly 61 moves under the bias of spring 98 to the left in FIG. 2 and thus locking the time lock 10. When snubber bar 21 is pulled through apertures 19, 20, block 83 automatically snaps up due to the energy stored in the compressed spring 88 and blocks the reinsertion of bar 21 until the clockwork mechanism 40 releases the block 83, and the lower end of the wire 121 near the end of the upward travel of the block 83 snaps forward over the uppermost rear edge of the camming surface 126 of leg 97 to assume its normal point of engagement with the member 94. It can also be seen that spring 98 serves two functions; it biases both carrier assembly 61 toward locking position and biases lever actuator 90 downwardly within slot 66.

When the desired time to release time lock 10 is reached, pins 44 abut against surfaces 63 of carrier assembly 61 and moves it to the right in FIG. 2 and thus releases lever actuator 90 (FIG. 12) from blocking engagement with portion 104. This moves lever actuator 90 to the left in FIG. 9 or to the FIG. 3 position which lowers block 83 and opens the time lock 10.

If it is desired to unlock time lock 10 before the preset time, the push-button 111 is lifted, as indicated in FIG. 13, and in the direction of the arrow 117 in FIG. 14, and moves to the left or the FIG. 13 position thus manually releasing block 83. Wire 121 moves over the curved portion 127 of surface 126 and cams against the surface 126 of leg 97 as shown in FIG. 13.

Any suitable materials, such as stainless steel, etc., and screws, bolts, etc., may be used to fabricate and assembly the various components.

I claim:

1. In a time lock having a housing, a clockwork mechanism mounted in said housing, a carrier assembly movably mounted in said housing, timed release means associated with said clockwork mechanism adapted to engage said carrier assembly at a preselected time to thereby move said carrier assembly, a snubber bar receiving aperture through said housing for receiving a snubber bar therethrough, snubber bar blocking means operatively engaging said carrier assembly and movable thereby when said carrier assembly is moved by said timed release means from a first position in blocking engagement in said aperture to a second position out of blocking engagement in said aperture, said snubber bar blocking means including an aperture in said carrier assembly and a lever assembly including a pivotal member located wholly rearwardly of said carrier assembly for movement about a stationary pivot axis and an elongated lever actuator extending through said aperture in said carrier assembly movable relative to the pivot axis in a longitudinal fore and aft direction generally normal to the carrier assembly between a forward position and a rearward position for controlling the position of the pivotal member, a block slidably mounted in said housing and having a depending extension portion, said pivotal member engaging the extension portion for movement of the block to the first position into blocking engagement in said snubber bar receiving aperture, said block being urged downwardly to the second position out of blocking engagement in said snubber bar receiving aperture at the forward position of the lever actuator and movable into blocking engagement therein by said lever assembly at the rearward position of the lever actuator, said carrier assembly aperture having abutment means thereon and said lever actuator having abutment engagement means thereon adapted to selectively engage said abutment means whereby said lever actuator is slidable forwardly through said carrier assembly aperture from said rearward position when said abutment engagement means is out of abutting relation with said abutment means and held at said rearward position in a fixed relation with respect to said carrier assembly when said abutment engagement means is in abutting engagement with said abutment means, and said lever actuator being manually tiltable upwardly while held in said rearward position by the interengaging abutment and engagement means to release the actuator to move to the forward position.

2. In the time lock of claim 1 wherein said abutment engaging means on said lever actuator is normally biased into engagement with said abutment means.

3. In the time lock of claim 1 including a push-button fixedly secured to said lever actuator and accessible outside of said housing, said push-button having a first outwardly and downwardly tapered portion, a second inwardly extending portion, and a third downwardly extending portion.

4. In the time lock of claim 1, further including antitampering means associated with said block for applying a restraining force to the block resisting movement of said block from its first to its second position due to inertia acting on said block, said antitampering means including an elongated wire member mounted in and projecting from said block and extending alongside said extension portion, and said pivotal member including a first abutment surface portion underlying said block for engaging and urging rearwardly the lowermost end portion of said elongated wire member when said block is in its second position and second abutment surface means on said pivotal member against which the lowermost end of said elongated wire member abuts when said lever actuator occupies said rearward position to position the elongated wire member to apply said restraining force to the block.

5. In a time lock as defined in claim 1, wherein said clockwork mechanism is mounted in the interior of said housing on a partition having a generally semi-circular groove therein, said housing having a back wall with a forward facing generally semi-circular groove therein mating with the groove in said partition, both said mating grooves forming a generally circular opening, said opening being said snubber bar receiving aperture.

6. A time lock having a housing, a clockwork mechanism mounted in said housing, a carrier assembly movably mounted in said housing, timed release means associated with said clockwork mechanism adapted to engage said carrier assembly at a preselected time to thereby move said carrier assembly, a snubber bar receiving aperture through said housing for receiving a snubber bar therethrough, snubber bar blocking means operatively engaging said carrier assembly and movable thereby when said carrier assembly is moved by said timed release means from a first position in blocking engagement in said aperture to a second position out of blocking engagement in said aperture, said snubber bar blocking means including an aperture in said carrier assembly, and an elongated lever extending through said aperture in said carrier assembly, said lever engaging a block slidably mounted in said housing for movement of the block to the first position into blocking engagement in said snubber bar receiving aperture, said block being urged downwardly to the second position out of blocking engagement in said snubber bar receiving aperture at one position of the lever and movable into blocking engagement therein by said lever at a second position of the lever, said carrier assembly aperture having abutment means thereon and said lever having abutment engaging means thereon adapted to selectively engage said abutment means whereby said lever is slidable through said carrier assembly aperture when said abutment engaging means is out of abutting engagement with said abutment means and held in a fixed relationship with respect to said carrier assembly when said abutment engaging means is in abutting engagement with said abutment means, said block being normally biased upwardly into blocking engagement in said snubber bar receiving aperture by a spring encircling a pin slidably mounted in said block when said lever occupies its second position, said pin terminating in a head portion at a point remote from said block and said snubber bar blocking means including a pivotal member having a first portion pivotally secured to said lever and a second portion underlying said head portion.

7. In the time lock of claim 6 wherein said abutment engaging means includes a notch in said lever, said block being held in its first position by said pivotal member when said notch is in engagement with said abutment means and manual release means associated with said lever for manually releasing said lever from abutment in engagement with said abutment means.

8. In the time lock of claim 7 wherein said manually release means includes a second notch on said lever spaced from said first notch and also having abutment engaging means thereon for engaging said abutment means for holding said block in its second position.

9. In the time lock of claim 6 further including antitampering means associated with said block for applying a restraining force to the block resisting movement of said block from its first to its second position due to inertia acting on said block.

10. In the time lock of claim 9 wherein said antitampering means includes an elongated member mounted in and projecting from said block and extending through an opening in said head portion, and said second portion of said pivotal member includes first abutment surface means thereon for engaging the lowermost end of said elongated member when said block is in its second position and second abutment surface means thereon for retaining the lowermost end of said elongated member between said first and second portions of said pivotal member and against said second portion.

11. In a time lock having a housing having front and back walls, a clockwork mechanism mounted in said housing, a carrier assembly movably mounted in said housing for lateral movement in a vertical plane paralleling the back wall, timed release means associated with said clockwork mechanism adapted to engage said carrier assembly at a preselected time to thereby move said carrier assembly, a snubber bar receiving aperture through said housing for receiving a snubber bar therethrough, snubber bar blocking means operatively engaging said carrier assembly and movably thereby when said carrier assembly is moved by said timed release means from a first position in blocking engagement in said aperture to a second position out of blocking engagement in said aperture, said snubber bar blocking means including a block slidably mounted in said housing and movable to said first position into blocking engagement in said snubber bar receiving aperture and having an extension portion depending therefrom, a lever assembly including an elongated control member movable in a fore and aft direction generally perpendicular to the plane of movement of the carrier assembly between a forward release position and a rearward lock position and extending through said carrier assembly, said carrier assembly having an aperture therein for passage of said control member therethrough, said lever assembly including a pivoted member located rearwardly of the carrier assembly engaging said extension portion and movable between the lock and release positions regulated by said control member, said block being urged downwardly to said second position out of blocking engagement in said snubber bar receiving aperture at the forward release position of the control member and movable into blocking engagement therein by said pivoted member at said rearward lock position of the control member, said carrier assembly aperture having a formation defining abutment means thereon and said control member having abutment engaging means thereon adapted to selectively engage said abutment means whereby said control member is slidable forwardly through said carrier assembly aperture from said lock position to said release position when said abutment engaging means is out of abutting engagement with said abutment means and held at said rearward lock position in a fixed relationship with respect to said carrier assembly when said abutment engaging means is in abutting engagement with said abutment means.

12. A time lock as defined in claim 11, wherein said abutment engaging means on said control member is normally biased into engagement with said abutment means.

13. A time lock as defined in claim 11, wherein said block is moved upwardly into blocking engagement in said snubber bar receiving aperture by a lifting means including said extension portion bearing against and extending downwardly from said block when the control member occupies its second position, said lifting means terminating in a head portion at a point remote from said block, and said lever assembly pivoted member having a first portion disposed in controlled relation to said control member and a second portion underlying said head portion.

14. A time lock as defined in claim 13, wherein said abutment engaging means includes a notch in said control member of said lever assembly, said block being held in its first position by said pivotal member and said control member when said notch is in engagement with said abutment means and manual release means associated with said lever assembly for manually releasing said notch from engagement with said abutment means.

15. A time lock as defined in claim 13, further including antitampering means associated with said block for applying a restraining force to the block resisting movement of the block from its first to its second position due to inertia acting on the block, said antitampering means including an elongated member mounted in and projecting from said block and extending alongside said extension portion, and said second portion of said pivoted member includes first abutment surface means thereon for engaging the lowermost end of said elongated member when said block is in its second position and second abutment surface means thereon for retaining the lowermost end of said elongated member between said first and second portions of said pivoted member and against said second portion to apply said restraining force to the block.

16. A time lock as defined in claim 11, further including antitampering means associated with said block for applying a restraining force to the block resisting movement of the block from its first to its second position due to inertia acting on said block, said antitampering means including an elongated wire member mounted in and projecting from said block and extending downwardly alongside said extension portion and having a lowermost end portion capable of being flexed rearwardly, and said pivotal member including a first abutment surface portion underlying said block for engaging and urging rearwardly the lowermost end portion of said elongated wire member when said block is in its second position and second abutment surface means on said pivotal member against which the lowermost end of said elongated wire member abuts when said lever actuator occupies said rearward position to position the elongated wire member to apply said restraining force to the block.

* * * * *